United States Patent [19]

Paakkinen et al.

[11] 4,114,818

[45] Sep. 19, 1978

[54] DISK REFINER

[75] Inventors: Ilmari Paakkinen, Nojanmaa; Seppo Häkkinen; Jouni Matula, both of Savonlinna, all of Finland

[73] Assignee: Enso-Gutzeit Osakeyhtio, Helsinki, Finland

[21] Appl. No.: 787,436

[22] Filed: Apr. 14, 1977

[30] Foreign Application Priority Data

Apr. 15, 1976 [FI] Finland ..... 761050

[51] Int. Cl.[2] ..... B02C 7/11

[52] U.S. Cl. ..... 241/244; 241/285 R

[58] Field of Search ..... 241/244, 245, 259.1, 241/259.2, 259.3, 285 R, 285 A

[56] References Cited

U.S. PATENT DOCUMENTS

| | | | |
|---|---|---|---|
| 2,931,586 | 4/1960 | Messing | 241/245 X |
| 2,947,485 | 8/1960 | Woodruff et al. | 241/259.2 X |
| 3,032,282 | 5/1962 | Asplund | 241/259.1 X |
| 3,118,622 | 1/1964 | Jones | 241/245 X |
| 3,827,644 | 8/1974 | Johansson | 241/259.3 |

*Primary Examiner*—Howard N. Goldberg
*Attorney, Agent, or Firm*—Lewis H. Eslinger

[57] ABSTRACT

A disk refiner construction to be supported on a base and including first and second frame parts, said first frame part having inside a pressure proof housing attached at its periphery to said first frame part, a shaft extending into said housing and provided with a gasketing sleeve serving as a gasket for said housing, a disk attached to the end of said shaft and provided with refiner plates within the housing, and an end plate of the refiner being attached to the first frame part and provided with stationary counter plates for said refiner plates, the second frame part having inside a bearing unit for the shaft of the refiner and said first and second frame parts constituting together an uninterrupted frame having the shape of a hollow rotational body and serving as a guide and support for the shaft and its bearings, said body being further provided with fixation points positioned symmetrically in relation to the shaft for supporting the disk refiner on its base.

4 Claims, 2 Drawing Figures

DISK REFINER

BACKGROUND OF THE INVENTION

1. Field of the Invention

The present invention relates to disk refiners used in the pulp and paper making industry for defibration and refining of wood substance. More specifically, the invention concerns a so-called single disk refiner, in which one disk fitted with refining plates rotates.

2. Description of the Prior Art

Disk refiners of the prior art present certain drawbacks, among the major drawbacks are the distortions in the frame of the refiner which result from temperature differences. These have the consequence that parallelism of the refining plates is not maintained during operation, which in its turn causes the pulp produced by the refiner to have a non-uniform freeness.

As the capacity of modern disk refiners increases, one is also compelled to increase the size of the refiners, whereby the refiner will attain large external dimensions and a long shaft will be necessary. The bearing arrangements of the shaft must ensure maintenance of parallelity of the refiner disks and adjustability of the refining gap between the refiner disks causes difficulties. Moreover, the space requirements are high.

SUMMARY OF THE INVENTION

According to the present invention there is provided a disk refiner construction which is intended to be supported on a mounting base and which comprises a first frame part having therein a pressure proof housing which is attached at its periphery to said first frame part; a shaft extending into said housing; a disk provided with refiner plates and attached to one end of the shaft within said housing; an end plate attached to said first frame part and provided with plates serving as stationary counter plates for said refiner plates; a sleeve member provided on the shaft and gasketing said housing; and a second frame part including bearing means for supporting the shaft, said first and second frame parts constituting for the refiner a uniform uninterrupted frame having the shape of a hollow rotational body and serving as a guide and support for the refiner shaft with its bearings, and further having fixation points provided symmetrically in relation to the shaft for supporting the refiner on its base.

It has been largely possible to eliminate the aforesaid drawbacks by the disk refiner of the invention, wherein on the end of a revolving shaft one of two refiner disks with its refining plates has been mounted. The bearing arrangement of the shaft is such that the shaft is disposed within a cylindrical sheath, and this in its turn is carried with the aid of sliding surfaces by the frame of the refiner. A pressure means is employed to urge the rotating refiner disk, which has been disposed in a special housing, against the stationary refining surface, which in combination with the housing constitutes a pressure-carrying refining chamber. This design has its advantages in the circumstance that the parallelity of the refining surfaces is maintained during the run, and in addition thereto the deformations resulting from the pressure within the housing and from the temperature changes may freely take place.

It is thus understood that the frame of the disk refiner according to the invention is the shape of a rotationally symmetrical, hollow body, the centre-line of which coincides with the longitudinal axis of the disk refiner.

The attachment planes of the frame have also been placed symmetrically close to the plane passing through the centre-line of the shaft of the refiner, so that two points of support lie in the immediate vicinity of the refining plates and one or two points of support, at the frontmost end of the frame as viewed towards the drive motor. In the frame at its front end an end plate is mounted, on which the stationary refining plates are disposed. Hereby the thermal expansions in the frame and the refining forces exercise a uniform effect in the direction of the structure's axis of symmetry and they will not give rise to any distortions of the frame, nor of the refining disks.

The housing of the above-mentioned pressure-resistant refining chamber has been placed within the conical portion of the frame of the refiner and impacted on its circumference between the frame and its end plate. The mode of fixing is such that thermal expansions in radial direction of the housing are free to take place. Since the housing is otherwise unrestiricted within the frame, there is nothing to obstruct its other deformations either which results from temperature changes and from pressure. Moreover, the two wall structures, one within the other, which are provided by the housing and by the frame, absorb the noise generated by the refining plates during operation of the refiner.

In this manner the refiner according to the invention could be given a small structural length, whereby it is also economical to manufacture.

BRIEF DESCRIPTION OF THE DRAWINGS

The invention is described below in detail by reference to the drawings, wherein.

DESCRIPTION OF THE PREFERRED EMBODIMENT

Figure 1:
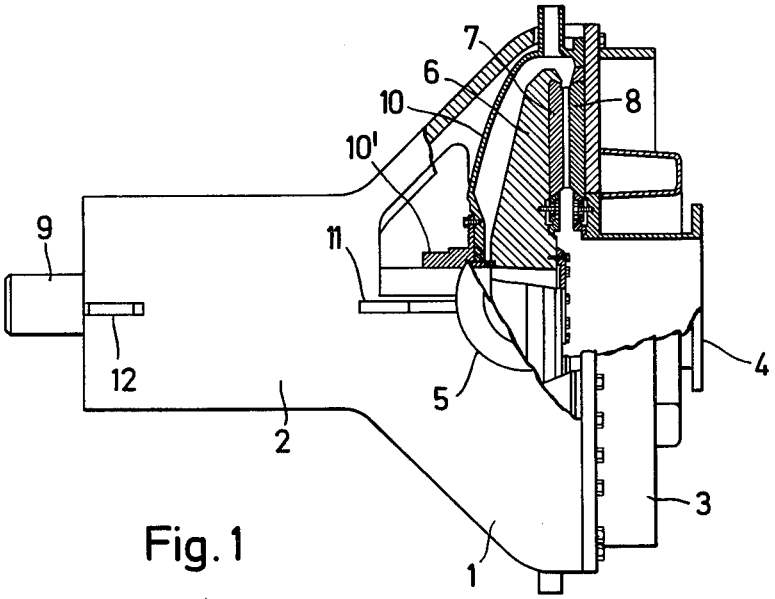
FIG. 1 presents in elevational view and with its upper part partly sectioned, a disk refiner according to the invention.
Figure 2:
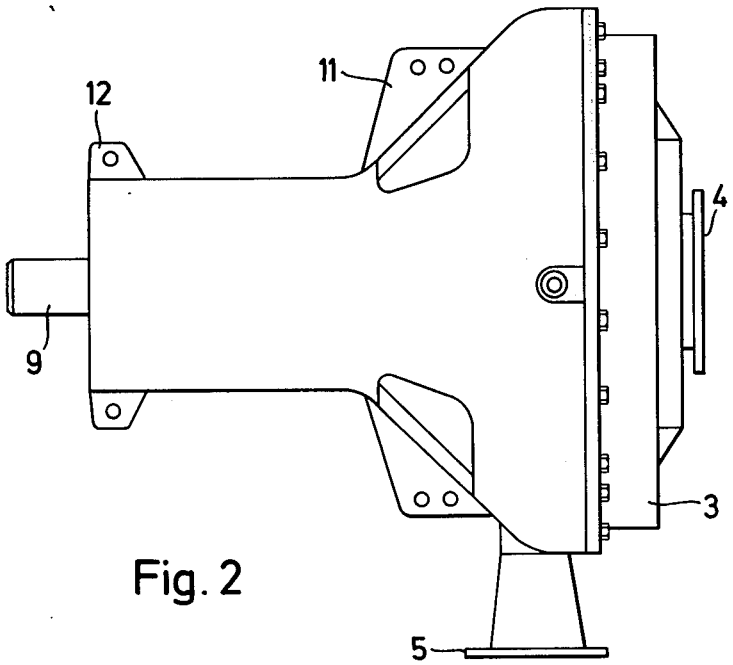
FIG. 2 shows a disk refiner according to the invention, viewed from above.

As has been shown in FIGS. 1 and 2, the frame of the disk refiner according to the invention consists of a conical first part 1 and a cylindrical second part 2 associated thereto, and of the end plate 3, attached by bolts on its periphery to the conical part 1. The end plate 3 has a connector 4 for the pulp supply. Within the conical part 1 there is a disk 6, rotable on the shaft 9, and provided with refining plates 7, whose mating stationary plates 8 are affixed to the end plate 3. Within the conical part there is a housing 10, which surrounds the rotating disk 6. The housing 10 is affixed by its circumference between the conical part 1 and its end plate 3. Hereby a refining chamber is formed around the rotating disk 6, from which the pulp may depart through a connector 5 situated at the periphery of the housing 10 and extending through the wall of the conical part 1. The housing 10 has been made resilient in that at its lower end adjacent to the shaft 9 it has been attached to a sleeve gasket 10', which encircles the shaft and wherein the shaft may slide axially, guided by a bearing means (not shown) disposed within the cylindrical part 2. It may be mentioned that the bearing means consists of an independently operating unit, which maintains the shaft affixed to the rotating disk 6, at any time, straight in the axial direction so that the parallelity of the plates 7 with reference to the mating plates 8 is maintained.

From the refining chamber constituted by the resilient housing 10 and the rigid end plate 3 the remarkable advantage is derived that when in the connector 4 the pressure of the pulp fed into the refiner increases, this pressure acts upon the resilient housing 10, which yields to the pressure because it has been affixed at its lower end by means of the sleeve bearing 10' to the shaft 9. As a consequence the pressure impact exerted on the frame part 1 is also attenuated, and no deformations are produced therein. Also loads resulting from high temperatures cannot exert their effect as far as to the frame, but they remain within the refining chamber.

The disk refiner according to the invention is carried on its mounting base which may be of the type described in the U.S. patent application Ser. No. 787,437, filed Apr. 14, 1977 simultaneously with this application at the support points 11, which are as close to the rotating refiner disk 6 as possible. They are symmetrically placed with reference to the frame part 1 of the refiner, and close to the vertical or horizontal plane extending through the centre-line of the refiner shaft 9. In the same plane, at the end adjacent to the drive motor of the refiner, there are another two symmetrically placed support points 12. If desired, these points of support 12 may also be replaced by one single point of support. As a result of the symmetrical geomtry of the refiner frame, and of the mode of support just described, all the thermal expansions and forces acting upon the frame are symmetrical and can only exert an influence in one direction, that is the axial direction, whereby the parallelity of the refining plates is maintained every moment, since no distortions occur in the frame.

What is claimed is:

1. A disk refiner adapted to be supported on a mounting base, comprising:

a first rigid frame part, a deformable resilient housing which is adapted to withstand pressure and deform in response to pressure variations in order to distribute pressure therein, said deformable housing being attached at its periphery to said first frame part;

a rotatable shaft extending into said deformable housing;

a disk having refiner plates thereon attached to one end of the shaft within said deformable housing;

an end plate secured to said first frame part adjacent said deformable housing and having plates thereon serving as stationary counter plates for said refiner plates on said disk;

sleeve means mounted on the shaft and connected to said housing for forming a gasket between the shaft and deformable housing; and a second rigid frame part including bearing means for supporting the shaft therein, said first and second frame parts constituting for the refiner a uniform uninterrupted frame having the shape of a hollow body of revolution and serving as a guide and support for the refiner shaft and said bearing means, said uninterrupted frame having fixation points thereon located symmetrically about the frame with respect to the shaft for supporting the refiner on its base.

2. A disk refiner according to claim 1, wherein the first frame part has the shape of a truncated cone and the second frame part has the shape of a cylinder.

3. A disk refiner according to claim 1, wherein the fixation points are situated in a plane extending through the center line of the refiner shaft.

4. A disk refiner according to claim 1, wherein the fixation points are situated in the first frame part as close to the rotating disk as possible.

* * * * *